United States Patent [19]

Floyd

[11] Patent Number: 4,859,244

[45] Date of Patent: Aug. 22, 1989

[54] PAPER SIZING

[75] Inventor: Jerome M. Floyd, Mobile, Ala.

[73] Assignee: International Paper Company, Tuxedo, N.Y.

[21] Appl. No.: 216,152

[22] Filed: Jul. 6, 1988

[51] Int. Cl.[4] ..... C08L 91/00; D21D 3/00

[52] U.S. Cl. ..... 106/243; 106/244; 162/158; 162/179

[58] Field of Search ..... 106/243, 244; 162/158, 162/179

[56] References Cited

U.S. PATENT DOCUMENTS 3,311,532 3/1967 Kulick et al. ..... 106/243
4,296,012 10/1981 Okumichi et al. ..... 106/287.24
4,721,655 1/1988 Trzasko et al. ..... 162/175

FOREIGN PATENT DOCUMENTS 825585 10/1969 Canada ..... 6/190

*Primary Examiner*—Theodore Morris
*Attorney, Agent, or Firm*—Luedeka, Hodges & Neely

[57] ABSTRACT

Improved resistance to liquid penetration of paper products may be produced by the use of an improved paper-sizing blend of a paper-sizing fatty acid anhydride and paper-sizing alkyl ketene dimer the weight ratio of the fatty acid anhydride to the alkyl ketene dimer being greater than 1.0 to 1.0 and not exceeding 4.0 to 1.0. The sized paper product also show an improved resistance to wicking and containers made from the paper products show an improved resistance to leakage when subjected to vibratory abuse.

3 Claims, No Drawings

PAPER SIZING

The present invention relates to sizing compositions for developing resistance to liquid penetration into paper and an improved sized paper product. In particular, the invention relates to a cationic sizing agent which comprises a major amount of a paper-sizing fatty acid anhydride and a minor amount of paper-sizing alkyl ketene dimer.

Hentrich et al. (U.S. Pat. No. 2,411,860) disclose that paper is rendered water-resistant when treated with higher ketene dimers. Kulick and Strazdins (U.S. Pat. No. 3,445,330) disclose development of water resistance with cationic emulsions of hydrophobic organic fatty acid anhydrides. Kulick, Savina, and Strazdins (U.S. Pat. No. 3,311,532) disclose the use of straight chain acyl compounds in combination with a paper-sizing ketene dimer to extend the activity of the dimer. The acyl compounds disclosed are higher fatty acids (i.e., contain 12 carbon atoms or more), and the corresponding anhydrides, amides, acid chlorides and aldehydes. The patent teaches that if the amount of acyl compound in the mixture exceeds the amount of dimer that the quality of sizing decreases substantially below that of the dimer alone.

Tests have shown that the Penescope readings when a paper board is sized with a mixture of ketene dimer and stearic acid drop precipitously from over about 18,000 seconds to about 1000 seconds when the amount of stearic acid in the size mixture exceeds about 50 percent (solution 20 percent lactic acid at 100° F. at 12 inch head). In contrast, when a size mixture in accordance with the invention contains a major portion of stearic anhydride and a minor proportion of ketene dimer (e.g. 1.5:1, or greater) the Penescope readings remain at a level of over about 18,000 seconds.

I have discovered that a paper sizing composition comprised of a paper-sizing fatty acid anhydride and a paper-sizing alkyl ketene dimer the weight ratio of the fatty acid anhydride to the alkyl ketene dimer being greater than 1.0 to 1.0 and not exceeding 4.0 to 1 can be employed in emulsion form to effectively size paper products. Preferably, the weight ratios are over 1.5 to 1.0 and not exceeding 4.0 to 1. Sizing economies and superior sizing performance of the present invention are associated with the employment of substantial amounts of the fatty acid anhydride in combination with lesser amounts of the alkyl ketene dimer. The sizing may be accomplished using the conventional paper making techniques. The use of my improved size composition also results in an improved paper product which has resistance to vibratory abuse to containers. It has been found that containers fabricated from the improved sized paper board are more resistant to leakage under conditions such as truck transport and the like.

The paper fatty acid anhydrides used in the present invention are the higher fatty acid anhydrides (over 12 carbon atoms). For example, suitable anhydrides are arachidic, behenic and stearic. They are hydrophobic and substantially water-insoluble.

The paper sizing alkyl diketene dimers are derived from essentially straight-chain higher fatty acids, such as stearic and/or palmitic acid.

Both the fatty acid anhydride and the alkyl ketene dimer are introduced into the papermaking fibers as cationic emulsions, separately or as a mixture. Emulsification of the hydrophobic sizing agents is accomplished in the presence of cationic agent such as a cationic corn or potato starch suitable for producing a positive charge on the emulsion particles. The prepration of the emulsion is in accordance with usual procedures, for example, as described in U.S. Pat. No. 3,311,532.

In order to facilitate a further understanding of the invention, the following examples are given for purposes of illustrating certain more specific details thereof.

EXAMPLE 1

The advantage of the present invention over that represented by U.S. Pat. No. 3,311,532 is demonstrated by a direct comparison of the sizing performance of blends of alkyl ketene dimer (AKD) with stearic anhydride and stearic acid. The emulsions were prepared in a manner similar to that described in U.S. Pat. No. 3,311,532, as follows:

Sodium lignosulfate, 0.15 g, was slowly added to 100 grams of a 3 percent, by weight, hot aqueous solution of a water-soluble cationic starch contained in a preheated Cenco cup mounted on a Waring Blender running at top speed. Flakes of AKD or AKD with the acyl compounds were melted together at 180° F. to provide various blends. With the starch solution at 180° F., ten grams of the molten sizing was then added and the mixing continued for 60 seconds. The emulsion was then rapidly cooled by dilution to 1 percent with cold distilled water. Final size concentration was 0.76 percent.

Handsheets were prepared by adding the various emulsions at a concentration equivalent to 4 pounds per ton to a stock suspension of bleached kraft pulp at a consistency of 0.6 percent, followed by addition of the equivalent of 8 pounds per ton of a commercial cationic potato starch. The slurry pH was adjusted to 6.3 with sulfuric acid and the stock sheeted to produce 140 gram/sq.M. handsheets.

The sized, dried sheets were subjected to a Penescope test employing, as the liquid, 20 percent lactic acid at 100° F. at a head of 12 inches. Each test was discontinued after 18,000 seconds if there was no observable penetration.

The results are shown in the following table:

| Weight Percent | | Penescope reading (seconds) when the acyl is: | |
|---|---|---|---|
| AKD | Acyl | Stearic Acid | Stearic Acid Anhydride |
| 100 | 0 | 18,000 | |
| 90 | 10 | 15,000 | 18,000 |
| 75 | 25 | 18,000 | 18,000 |
| 50 | 50 | 18,000 | 18,000 |
| 40 | 60 | 900 | 18,000 |
| 30 | 70 | Approx. 0 | 18,000 |
| 20 | 80 | — | 18,000 |

The Penescope readings drop precipitously from over about 18,000 seconds to about 900 seconds when the amount of stearic acid in the size mixture exceeds about 50 percent. In contrast, Penescope readings of paper treated with a size mixture that has a major proportion of stearic acid anhydride remain at a level of over about 18,000 seconds. This comparison shows the significant improvement in resistance to liquid penetration when a fatty acid anhydride (FAA) is combined with an alkyl ketene dimer in the sizing mixture.

Further testing of the handsheets demonstrates improved resistance to edge penetration. Rectangular cards from the handsheets are laminated on both sides with polyethylene film and fully immersed for 30 minutes in a 180° F. solution of 20 percent lactic acid dyed with 5 grams/liter methylene blue. The edge of each card is exposed to the liquid and the weight increase determined. Sizing quality is inverse to the weight increase. Results are shown in the following table.

| Weight Percent | | Absorbed liquid (grams/100 linear inches) when the acyl is | |
|---|---|---|---|
| AKD | Acyl | Stearic Acid | Stearic Acid Anhydride |
| 100 | 0 | 2.2 | — |
| 90 | 10 | 2.0 | 4.3 |
| 75 | 25 | 1.9 | 2.3 |
| 50 | 50 | 1.8 | 1.8 |
| 40 | 60 | 2.6 | 2.0 |
| 30 | 70 | 3.2 | 2.7 |
| 20 | 80 | 5.3 | 2.4 |
| 0 | 100 | 7.7 | 2.1 |

The amount of liquid absorbed by the card increased significantly when the amount of stearic acid in the size mix exceeds about 50 percent. In contrast, the cards treated with a size mix which contains a major proportion of stearic acid anhydride absorb a nearly constant amount of liquid. This shows the significant improvement in wicking resistance in paperboard prepared in accordance with the invention.

EXAMPLE 2

A commercially prepared ketene dimer emulsion (Hercon® cationic ketene dimer, Hercules Incorporated) was blended with laboratory-prepared stearic anhydride emulsions in a manner similar to that described in Example 1. Combined size dosage was 3 or 5 pounds/ton and the size composition was 60/40 or 40/60 AKD/FAA, pure AKD, or pure FAA.

Handsheets were prepared as in Example 1 and subjected to wicking tests with four different liquids. The results are shown in the following table.

| AKD/FAA (% by Weight) | Pounds/Ton | Amount Absorbed (Grams/100 Linear Inches) A | B | C | D |
|---|---|---|---|---|---|
| 100/0 | 5 | 2.33 | 0.94 | 0.75 | 0.85 |
| 60/40 | 5 | 1.45 | 0.83 | 1.67 | 0.87 |
| 40/60 | 5 | 0.81 | 0.74 | 0.27 | 0.73 |
| 40/60 | 3 | 0.41 | 0.74 | 0.29 | 0.72 |
| 60/40 | 3 | 1.51 | 0.83 | 0.62 | 0.84 |
| 0/100 | 3 | 1.14 | 0.97 | 0.39 | 0.90 |

A: 50% Aqueous ethanol, 30 seconds at 75° F.
B: 1% Lactic acid, 24 hours at 40° F.
C: 20% Lactic acid, 30 minutes at 100° F.
D. Distilled water, 24 hours at 75° F.

The superior resistance to wicking is obtained when FAA is a major component. The sizing mixture comprised of 40 percent AKD and 60 percent FAA provides a substantially better resistance to wicking than either AKD or FAA used alone. The invention also provides a significantly improved wicking resistance to wicking when compared to prior art, as represented by the sizing mixture comprised of 60 percent AKD and 40 percent FAA.

EXAMPLE 3

Rollstock was prepared on a small fourindier paper machine designed to simulate a full-scale commercial operation. The sizing composition was prepared by preblending a commercial Hercon® ketene dimer emulsion and a stearic anhydride emulsion prepared in a manner similar to Example 1. The sizing composition was added into the bleached kraft pulp slurry before sheeting in a manner similar to that normally practiced on a commercial-scale fourdrinier machine. The paperboard produced was then subjected to a wicking test. The efficiency of alkyl ketene dimers is known to be adversely affected by alum and high levels of alkalinity obtained by addition of sodium bicarbonate. The results are shown in the table below.

| Size | 100% AKD | | | 60/40 FAA/AKD | | | |
|---|---|---|---|---|---|---|---|
| Size Dosage, pounds/t | 4.6 | 4.8 | 4.7 | 4.7 | 4.7 | 4.7 | 4.7 |
| Total Alum, pounds/t | 7.1 | 0.0 | 0.0 | 7.0 | 0.0 | 0.0 | 20.5 |
| Sodium bicarbonate, pounds/t | 0.0 | 40.7 | 0.0 | 0.0 | 40.7 | 0.0 | 0.0 |
| Calcium carbonate, pounds/t | 0.0 | 0.0 | 76.0 | 0.0 | 0.0 | 76.0 | 0.0 |
| Wicking, grams/100 lin. in. | | | | | | | |
| 20% lactic acid 30 min. @ 100 F. | 4.6 | 9.8 | 1.3 | 0.6 | 0.7 | 0.6 | 0.5 |
| 50% aque. Et OH 30 sec. @ 73 F. | 4.2 | 4.2 | 4.2 | 1.4 | 1.6 | 1.4 | 2.0 |

Paper produced with a sizing mixture of 60 percent FAA and 40 percent AKD shows an improved resistance to wicking over paper produced with pure AKD sizing. In addition, the sizing quality is subtantially unaffected by the presence of alum or high alkalinity. This is in contrast to the sizing quality demonstrated by paper produced with pure AKD sizing in the presence of alum or high alkalinity.

EXAMPLE 4

The improvement in resistance to liquid penetration in paperboard containing the FAA/AKD blend provides an improved resistance to leakage during vibratory abuse to filled containers made therefrom. Rollstock was prepared as described in Example 3 above with 4.7 pounds/ton of the size mixture. No sodium bicarbonate or calcium carbonate was used. The resulting containers were filled with commercial skim milk, a commercial grape drink beverage containing an antioxidant and a 5 percent aqueous ethanol solution. The containers were submitted to vibratory abuse designed to simulate motor truck distribution. The comparative performance of the size blend is listed below. (AKD Type 1 is Hercon® cationic alkyl ketene dimer, Hercules Incorporated; AKD Type 2 is Keydime® cationic alkyl ketene dimer, Albright and Wilson Americas, Inc.)

| Size System | AKD | | 60/40 FAA/AKD | |
|---|---|---|---|---|
| AKD type | 1 | 1 | 2 | 2 |
| Total alum. pound/ton | 7 | 21 | 21 | 7 |
| Leaks/10 containers | | | | |
| Skim milk 75 min. abuse | 12.0 | 10.5 | 10.5 | 11.0 |
| Grape drink | | | | |
| 30 minutes | 17.2 | 9.2 | 9.0 | 11.2 |
| 60 minutes | 25.5 | 17.0 | 18.8 | 20.8 |
| 90 minutes | 27.5 | 22.5 | 22.0 | 24.5 |
| 5% Aqueous ethanol | | | | |
| 30 minutes | 16.7 | 8.0 | 9.0 | 9.2 |
| 60 minutes | 25.0 | 12.8 | 14.5 | 10.2 |
| 90 minutes | 27.5 | 19.5 | 20.5 | 21.5 |

Paperboard prepared with a sizing mixture comprised of a majority of FAA and a minority of AKD shows a significant improvement in resistance to leakage when compared to paperboard prepared with an AKD sizing alone. Leakage is reduced between about 10 percent and about 60 percent.

From the foregoing, it can be seen that the invention provides an improvement in the economy of sizing paper with fatty acid anhydrides or alkyl ketene dimers. In addition, the invention provides improved resistance to penetration by liquids and wicking in paperboard prepared in accordance with the invention. Containers prepared from the paperboard show improved resistance to leakage under vibratory conditions. It also provides a sizing which is highly resistant to penetration by liquids containing alcohol.

Various of the features of the invention which are believed to be novel are set forth in the appended claims.

What is claimed is:

1. A paper-sizing composition for application to paper to provide to the sized paper an improved resistance to liquid penetration and an improved resistance to leakage when the sized paper is subjected to vibratory abuse, the composition comprising a mixtue of a paper-sizing fatty acid anhydride and a paper-sizing alkyl ketene dimer, the weight ratio of the fatty acid anhydride to the alkyl ketene dimer being greater than about 1.5 to 1.0 and not exceeding 4.0 to 1.0.

2. The composition of claim 1 wherein the paper-sizing fatty acid anhydride is stearic anhydride.

3. The composition of claim 1 wherein the alkyl ketene dimer is derived from a blend of palmitic and stearic acids.

* * * * *